US005956916A

United States Patent [19]

Liss

[11] Patent Number: 5,956,916

[45] Date of Patent: Sep. 28, 1999

[54] SHEAR TAB METHOD AND APPARATUS

[75] Inventor: George Louis Liss, Littleton, Colo.

[73] Assignee: Steel Floors, LLC, Greenwood Village, Colo.

[21] Appl. No.: 08/961,635

[22] Filed: Oct. 30, 1997

[51] Int. Cl.[6] ..... E04B 5/00

[52] U.S. Cl. ..... 52/655.1; 52/656.9; 52/480; 52/650.1; 52/481.1; 52/281

[58] Field of Search ..... 52/655.1, 645, 52/656.9, 480, 650.1; 403/403, 231, 3, 4

[56] References Cited

U.S. PATENT DOCUMENTS

| | | | |
|---|---|---|---|
| 947,514 | 1/1910 | Stevens | 52/480 |
| 2,106,084 | 1/1938 | Coddington | 52/376 |
| 2,744,590 | 5/1956 | Butts | 52/645 |
| 3,685,866 | 8/1972 | Patenaude | 52/721 X |
| 3,818,662 | 6/1974 | Deschutter . | |
| 3,845,601 | 11/1974 | Kostecky . | |
| 3,854,192 | 12/1974 | O'Konski . | |
| 4,002,001 | 1/1977 | Uydess | 52/731.5 |
| 4,042,991 | 8/1977 | Macy et al. | 52/645 X |
| 4,047,348 | 9/1977 | McSweeney . | |
| 4,288,958 | 9/1981 | Chalmers et al. . | |
| 4,538,391 | 9/1985 | Skrabis et al. . | |
| 4,625,948 | 12/1986 | Lustvee . | |
| 4,827,681 | 5/1989 | Platt . | |
| 4,894,967 | 1/1990 | Morton . | |
| 4,912,849 | 4/1990 | Platt . | |
| 5,137,390 | 8/1992 | Felsen . | |
| 5,149,221 | 9/1992 | Slapsys . | |
| 5,596,859 | 1/1997 | Horton et al. . | |
| 5,625,995 | 5/1997 | Martin | 52/715 |
| 5,857,306 | 1/1999 | Pellock | 52/643 |

*Primary Examiner*—Carl D. Friedman
*Assistant Examiner*—Jennifer I. Thisseu
*Attorney, Agent, or Firm*—Rick Martin

[57] ABSTRACT

An improved ledger beam is provided which securely forms a load transferring connection with joist members without the need for separate material connectors which must be welded or fastened to the ledger beam. The ledger beam has a series of shear tabs integrally formed from the ledger beam's parent material which serve as points of fastening between the ledger beam and the joists. Also provided is a method of transferring loads from joist members to ledger members in a structural floor arrangement without the need for separate material connectors which must be welded or fastened to the ledger beam.

27 Claims, 4 Drawing Sheets

SHEAR TAB METHOD AND APPARATUS

FIELD OF INVENTION

The present invention relates to an improved shear tab connecting directly to support joists and a method for producing said shear tab by punching it out of a ledger support beam.

BACKGROUND OF THE INVENTION

In several building construction situations it is desirable to suspend the floor support beams above the soil. Such may be the case where expansive soils which could cause future damage to ground level floor surfaces are present at the building site. One of the floor support systems commonly utilized by the construction industry to alleviate such problems is a structural floor arrangement.

In the structural floor arrangement, ledger beams are horizontally affixed above the soil level to the concrete foundation walls. A series of joist members running parallel to one another and perpendicular to the inner faces of the ledger beams are attached to the ledger beams. In order to transfer loads from the individual joist members to the supporting ledger beams, a mechanical connection is required. Historically, for light gauge steel framing members, a light gauge steel clip angle connector is screwed to both the ledger beam and the supported joist. As such, building contractors incur more than the cost of the ledger and joist members when utilizing the structural floor arrangement. Contractors must also include the price of the clip angle connector (roughly $1 per joist), associated screws (roughly 8¢ per joist) and labor to install these items (roughly 52¢ per joist) in their overall cost of production. When one considers the number of clip angle connectors and screws needed for each joist employed in a sizable number of construction projects, the extra associated costs are considerable.

What is needed in the art is an improved ledger beam which securely forms a load transferring connection to joist members. The present invention eliminates the need for employing clip angle connectors. The present invention incorporates a shear tab which is formed into the ledger beam parent material during production. The shear tab transfers joist loads to the ledger beam. The ledger beam, in turn, imparts the loads to the foundation wall via expansion bolts. This shear tab is similar in geometry to what the American Institute of Steel Construction in its Steel Construction Manual refers to as a single-plate shear connection. The shear tab protrudes away from the ledger beam and offers a surface by which the joist can be fixably attached to the ledger beam. This attachment is accomplished without the need for a separate piece of material welded or fastened to the ledger beam.

Listed below are samples of patents based in part on punching out a portion of a metal panel. These patents are merely representative of the art and do not suggest the teachings of the present invention:

U.S. Pat. No. 5,596,859 (1997) to Horton et al. discloses pre-punched passageways in a metal wall stud.

U.S. Pat. No. 5,149,221 (1992) to Slapsys discloses a clip used to suspend ceiling tees.

U.S. Pat. No. 5,137,390 (1992) to Felsen discloses a channel bottom 26 punched out of a rigid plate used in ceiling grid construction.

U.S. Pat. No. 4,912,849 (1990) to Platt discloses interlocking cross tees for ceilings.

U.S. Pat. No. 4,894,967 (1990) to Morton discloses a steel deck stiffener having support tabs punched out of a horizontal support beam.

U.S. Pat. No. 4,827,681 (1989) to Platt discloses an interlocking cross tee for ceilings.

U.S. Pat. No. 4,625,948 (1986) to Lustvee discloses a picket-fence construction in which beam 3 includes a punch tab 10 which is used for connecting with other beams [FIGS. 2–3]. Also see FIG. 1 for the holes to secure beam 3 to a supporting structure.

U.S. Pat. No. 4,538,391 (1985) to Skrabis et al. discloses a wall panel having integral clips 31 which are used to connect the panel to other structures [see FIGS. 1–6].

U.S. Pat. No. 4,288,958 (1981) to Chalmers et al. discloses a horizontal siding panel system with vertical stringers. See FIGS. 1–2 for the punch tabs and the holes for securing the stringers 12 to the wall and panels 10.

U.S. Pat. No. 4,047,348 (1977) to McSweeney discloses a ceiling-support grid system.

U.S. Pat. No. 3,854,192 (1974) to O'Konski discloses a method to level a horizontal brace through a hole in a vertical stud.

U.S. Pat. No. 3,845,601 (1974) to Kostecky discloses a metal wall framing system where certain panels have punch-out tabs.

U.S. Pat. No. 3,818,662 (1974) to DeSchutter discloses a wall retainer where certain members have punch-out tabs.

SUMMARY OF THE INVENTION

The primary aspect of the present invention is to provide an improved ledger beam which securely forms a load transferring connection with joist members without the need for separate material connectors which must be welded or fastened to the ledger beam.

Another aspect of the present invention is to provide a method of transferring loads from joist members to ledger members in a structural floor arrangement without the need for separate material connectors which must be welded or fastened to the ledger beam.

Another aspect of the present invention is to provide an improved ledger beam incorporating pre-punched mounting holes allowing coupling of the ledger beam with a cement foundation wall while reducing field labor costs of drilling those holes.

Other aspects of this invention will appear from the following description and appended claims, reference being made to the accompanying drawings forming a part of this specification wherein like reference characters designate corresponding parts in the several views.

The present invention provides an improved ledger beam which securely forms a load transferring connection to joist members. The present invention eliminates the need for employing clip angle connectors. The present invention incorporates a plurality of shear tabs which are formed into the ledger beam parent material during production. Each shear tab transfers joist loads to the ledger beam. The ledger beam, in turn, imparts the loads to the foundation wall via expansion bolts. The shear tab protrudes away from the ledger beam and offers a surface by which the joist can be fixably attached to the ledger beam. This attachment is accomplished without the need for a separate piece of material welded or fastened to the ledger beam.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
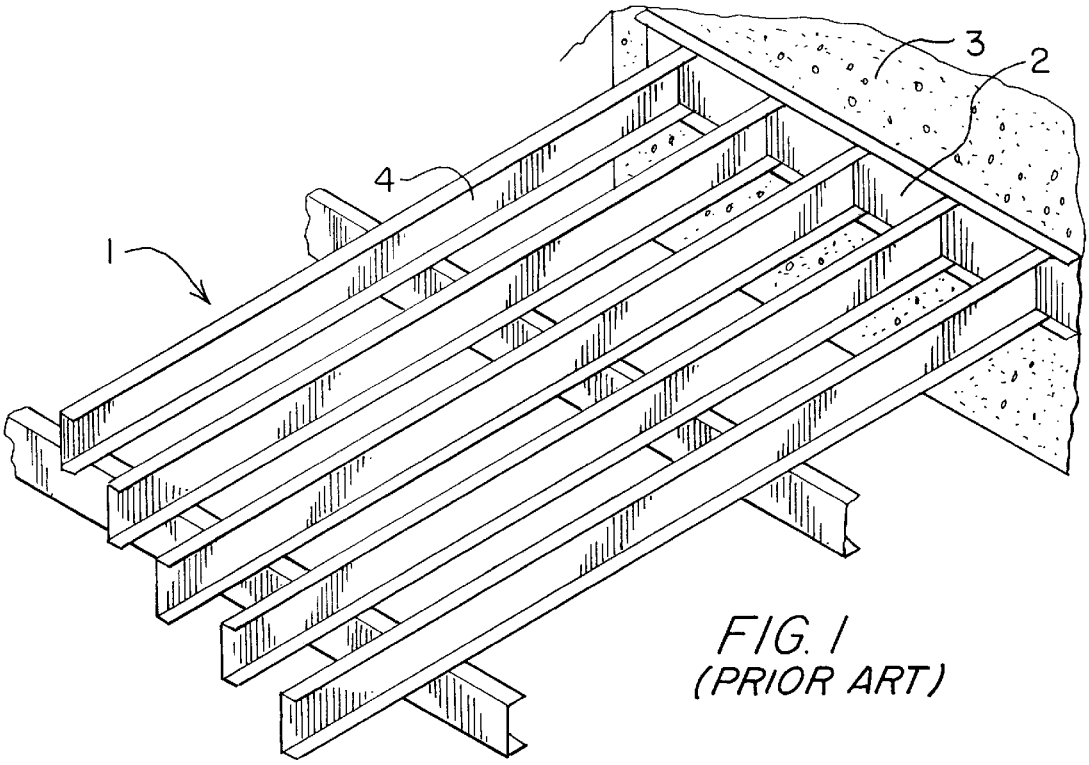
FIG. 1 (PRIOR ART)
FIG. 1 (prior art) is a top perspective view of a conventional floating floor arrangement.

Referring first to FIG. 1 a structural floor arrangement 1 is comprised of a series of joist members 4 fixably attached to at least one conventional ledger beam member 2. Each ledger beam member 2 is fixably attached to a foundation wall 3. The structural floor arrangement provides a floor surface elevated above the soil level.

Figure 2:
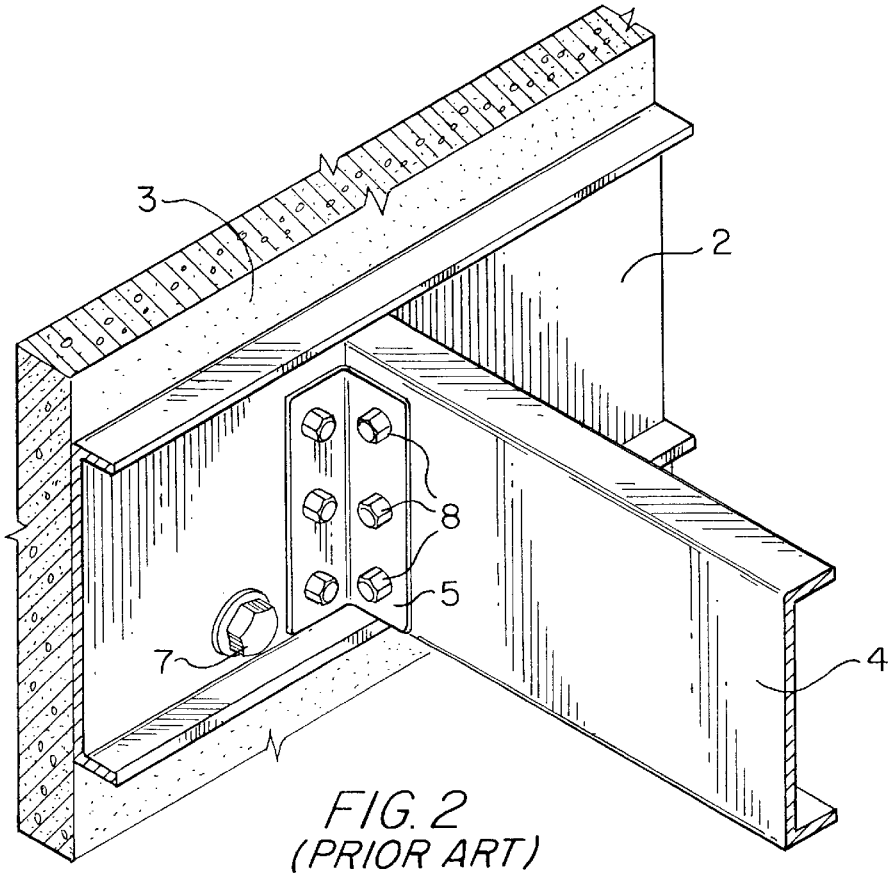
FIG. 2 (PRIOR ART)
FIG. 2 (prior art) is a top perspective view of a conventional ledger-joist attachment using a clip angle connector.

Referring next to FIG. 2 shown is a conventional ledger beam member 2 fixably attached to a foundation wall 3 by an expansion bolt 7. A joist member 4 perpendicularly disposed to the ledger beam member is fixably attached to the ledger beam member by a clip angle connector 5 using screws 8.

Figure 3:
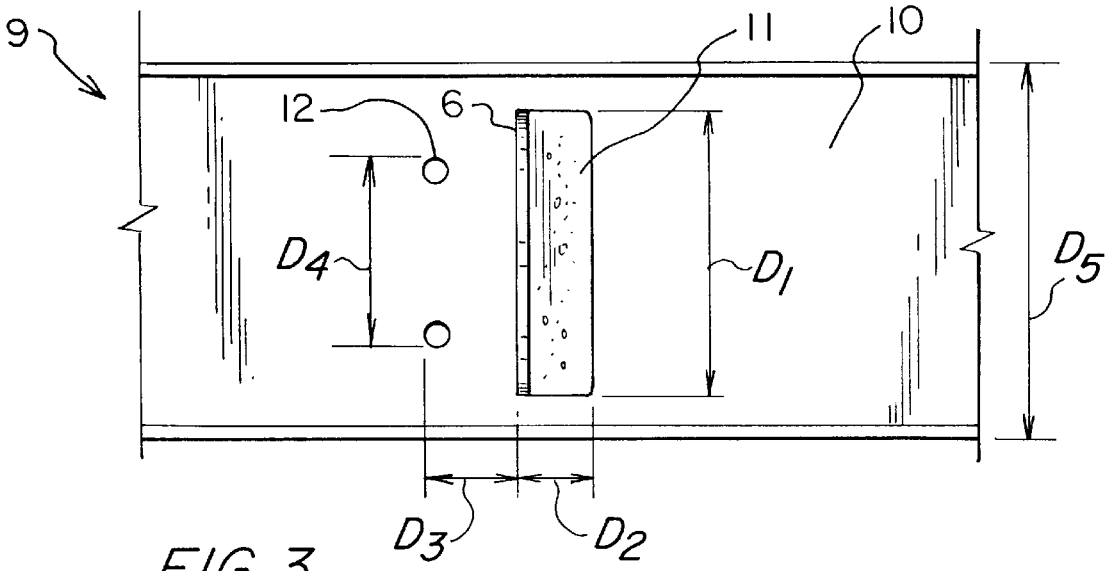
FIG. 3 is a side plan view of the preferred embodiment shear tab ledger beam.

Referring next to FIG. 3 shown is a shear tab ledger member 9. A shear tab 6 is punched from the material from the shear tab ledger planar surface 10. Once the shear tab is punched and formed perpendicularly to the planar surface, a shear tab formation hole 11 is simultaneously formed. Expansion bolt holes 12 allow affixation of the shear tab ledger beam to a foundation wall. The expansion bolt holes 12 are drilled at the site of installation of the shear tab ledger beam.

Figure 4:
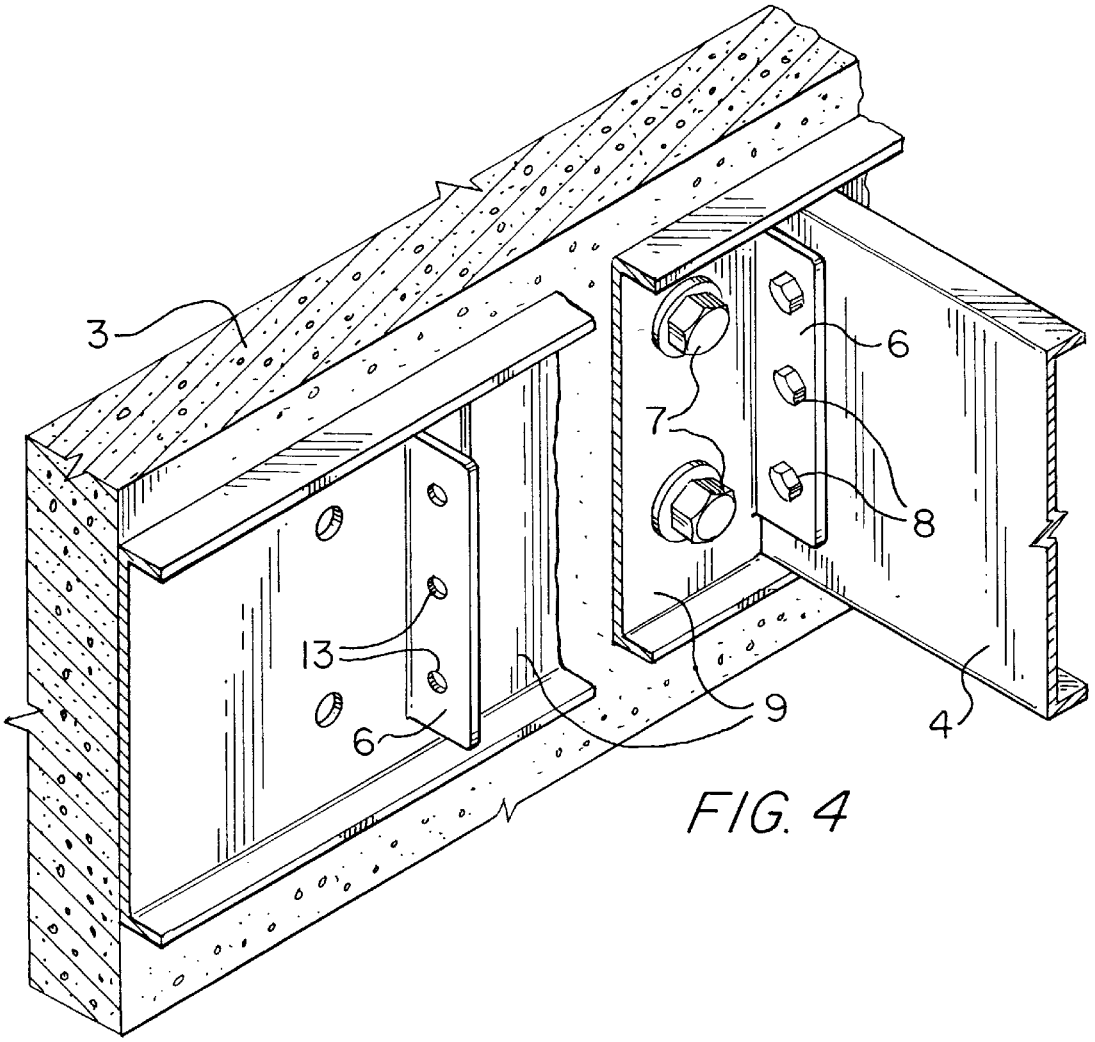
FIG. 4 is a combination top perspective view of the preferred embodiment shear tab ledger-joist attachment and a top perspective view of the preferred embodiment shear tab ledger beam.

Referring next to FIG. 4 shown is a portion of a shear tab ledger member 9 fixably attached to a foundation wall 3 by expansion bolts 7. A joist member 4 perpendicularly disposed to the shear tab ledger member is fixably attached to the shear tab ledger member by a shear tab 6. Drilling of screw holes 13 in the shear tab allows attachment of the joist member to the shear tab by the use of screws 8.

Figure 5:
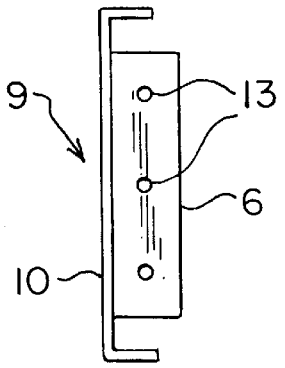
FIG. 5 is a front plan view of the preferred embodiment shear tab ledger beam shown in FIG. 3.

Referring next to FIG. 5 shown is a shear tab ledger member 9. A shear tab 6 is punched from the material from the shear tab ledger planar surface 10. Drilling of screw holes 13 in the shear tab allows attachment of a joist member to the shear tab by the use of screws.

Figure 6:
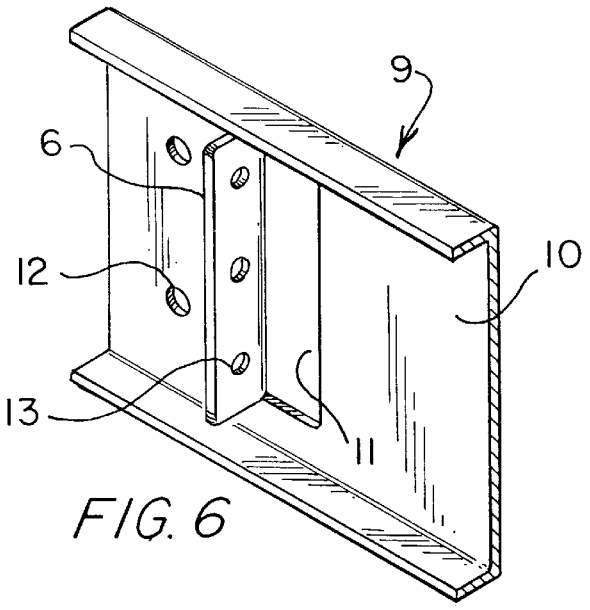
FIG. 6 is a top perspective view of the preferred embodiment shear tab ledger beam shown in FIGS. 3 and 5.

Referring next to FIG. 6 shown is a portion of a shear tab ledger member 9. A shear tab 6 is punched from the material forming the shear tab ledger planar surface 10. Once the shear tab is punched and formed perpendicularly to the planar surface, a shear tab formation hole 11 is simultaneously formed. Drilling of screw holes 13 in the shear tab allows attachment of a joist member to the shear tab by the use of screws. Expansion bolt holes 12 allowing affixation of the shear tab ledger beam to a foundation wall are drilled at the site of installation of the shear tab ledger beam.

Figure 7:
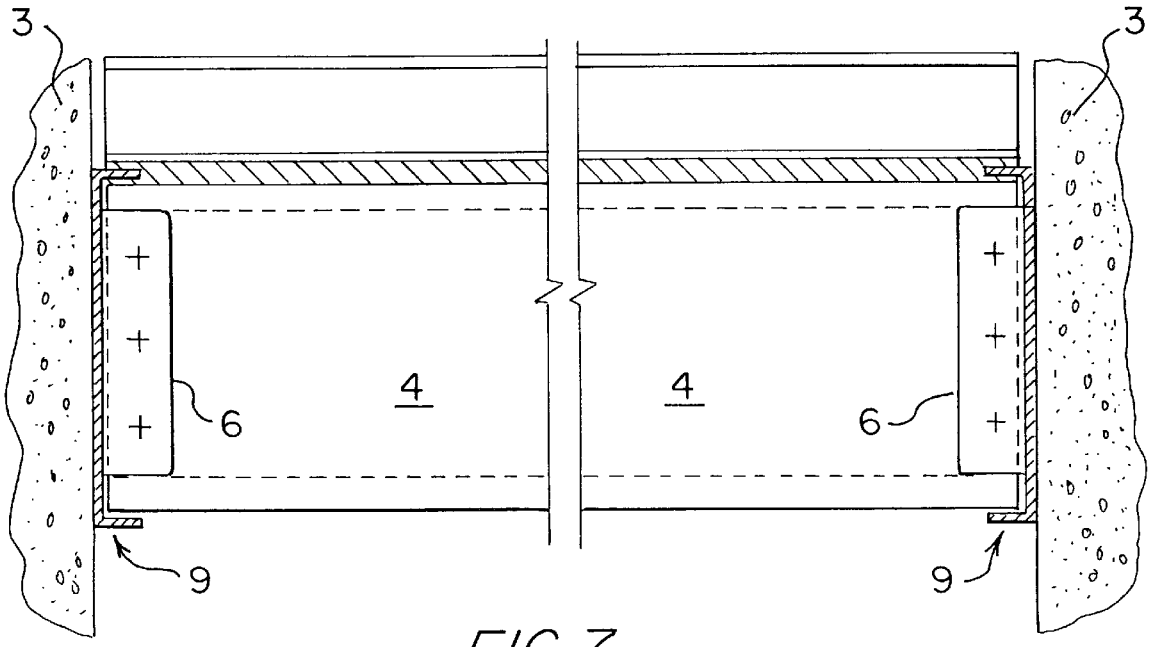
FIG. 7 is a front plan view of the preferred embodiment shear tab ledger-joist attachment.

Referring next to FIG. 7 shown are shear tab ledger members 9 fixably attached to foundation walls 3. A joist member 4 perpendicularly disposed to the shear tab ledger members is fixably attached to the shear tab ledger members by shear tabs 6.

Figure 8:
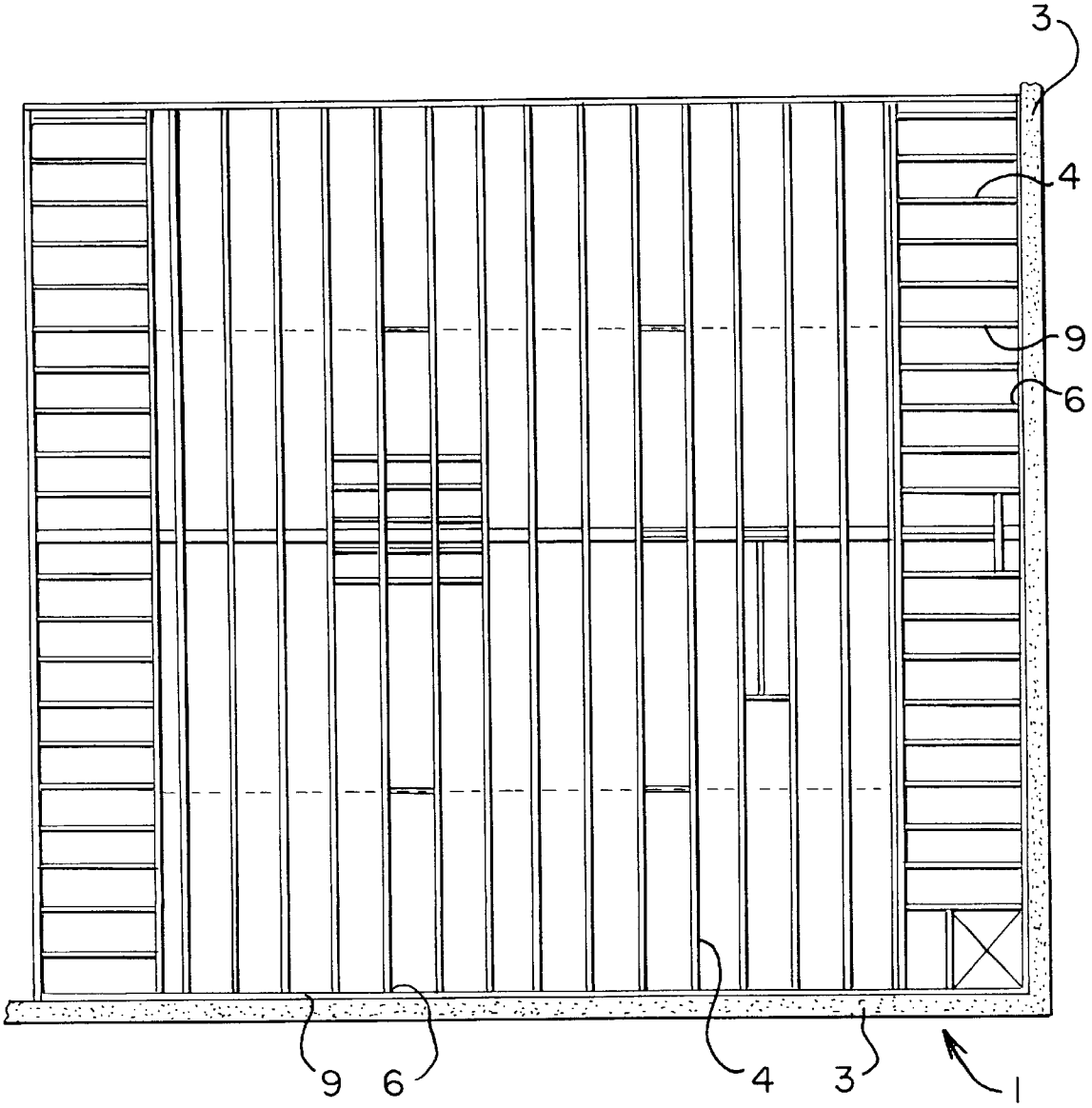
FIG. 8 is a top view of a floating floor arrangement implementing the preferred embodiment shear tab ledger-joist attachments.

Referring next to FIG. 8 shown is a typical structural floor arrangement 1. Shear tab ledger members 9 are fixably attached to foundation walls 3. Joist members 4 perpendicularly disposed to the shear tab ledger members are fixably attached to the shear tab ledger members by shear tabs 6. As can be seen in FIG. 8, a typical structural floor arrangement utilizes well over one hundred shear tab ledger member-joist connections thereby demonstrating the potential cost savings associated with the use of shear tabs. Herein disclosed is an improved method of transferring loads from joist members to ledger members comprising the steps of integrally forming at least one joist coupler from a planar surface of a ledger member, forming at least one joist connector along said joist coupler, integrally forming at least one wall coupler from said planar surface, and securably attaching a joist member to each said joist connector of each said joist coupler. The joist couplers and joist connectors are punched during production of the ledger member.

Also herein disclosed is an improved method of transferring loads from joist members to ledger members in a structural floor arrangement comprising the steps of integrally forming a plurality of shear tabs from a planar surface of a ledger member, forming a plurality of screw holes along said shear tabs, integrally forming a plurality of expansion bolt holes from said planar surface, and securably attaching a joist member to said shear tab via said screw holes. The shear tabs and screw holes are punched during production of the ledger member.

Also herein disclosed is an improved method of transferring loads from joist members to ledger members comprising the steps of integrally forming at least one means for joist coupling from a planar surface of a ledger member functioning as a coupling surface between said means for joist coupling and a joist, forming at least one means for joist connecting along said means for joist coupling functioning to allow securable attachment of a joist to said means for joist coupling, integrally forming at least one means for wall coupling from said planar surface functioning to allow securable attachment of said ledger member to a foundation wall, and securably attaching a joist member to each said means for joist connecting of each said means for joist coupling. The means for joist coupling and means for joist connecting are punched during production of the ledger member.

Although the present invention has been described with reference to preferred embodiments, numerous modifications and variations can be made and still the result will come within the scope of the invention. No limitation with respect to the specific embodiments disclosed herein is intended or should be inferred.

GLOSSARY

1. Floating floor arrangement
2. Ledger beam member
3. Foundation wall
4. Joist member
5. Clip angle connector 6. Shear tab
7. Expansion bolt
8. Screws
9. Shear tab ledger member
10. Shear tab ledger planar surface
11. Shear tab formation hole
12. Expansion bolt holes
13. Screw holes

I claim:

1. An improved metal floor support system having a ledger, said ledger comprising:

a rigid support member having a planar surface;

a plurality of joist couplers integrally formed along a length of said planar surface;

at least one joist connector for each of said joist couplers; and at least one wall coupler integrally formed from said planar surface.

2. The apparatus of claim 1, wherein each of said joist couplers further comprises a shear tab protruding substantially perpendicularly from said planar surface.

3. The apparatus of claim 1, wherein each of said joist connectors further comprises a screw.

4. The apparatus of claim 3, wherein the joist connector further comprises the screw secured in said screw hole.

5. The apparatus of claim 1, wherein said wall coupler further comprises an expansion bolt hole in said planar surface.

6. An improved ledger comprising:

a rigid support member having a planar surface;

a plurality of shear tabs protruding substantially perpendicularly from said planar surface, said shear tabs integrally formed from said planar surface along a length thereof;

a screw for said shear tabs to secure the shear tabs to a respective joist; and a plurality of expansion bolt holes formed from said planar surface.

7. An improved ledger comprising:

a rigid support member having a planar surface;

at least one means for joist coupling integrally formed from said planar surface functioning as a load transferring connection between said means for joist coupling and a joist;

at least one means for joist connecting formed along said means for joist coupling functioning to allow securable attachment of the joist to said means for joist coupling; and at least one means for wall coupling integrally from said planar surface functioning to allow securable attachment of said rigid support member to a wall, thereby structurally uniting the joist member with the wall.

8. The apparatus of claim 7, wherein said means for joist coupling further comprises a shear tab protruding substantially perpendicularly from said planar surface.

9. The apparatus of claim 7, wherein said means for joist connecting further comprises a screw hole and a screw therethrough.

10. The apparatus of claim 7, wherein said means for wall coupling further comprises an expansion bolt hole.

11. An improved method of transferring loads from joist members to ledger members comprising the steps of:

integrally forming a plurality of joist couplers along a length of a planar surface of a ledger member; and securably attaching a joist member to each said joist coupler;

wherein at least one wall coupler is integrally formed from said planar surface to allow attachment to a foundation wall.

12. The method of claim 11, wherein said joist coupler further comprises a shear tab protruding substantially perpendicularly from said planar surface.

13. The method of claim 11, wherein each of said joist couplers further comprises a screw joining said joist to said joist coupler.

14. An improved method of transferring loads from joist members to ledger members comprising the steps of:

integrally forming at least one means for joist coupling from a planar surface of a ledger member functioning as a coupling surface between said means for joist coupling and a joist; and securably attaching a joist member to each said means for joist coupling;

wherein at least one means for wall coupling is integrally formed from said planar surface functioning to allow securable attachment of said ledger member to a foundation wall.

15. The method of claim 14, wherein said means for joist coupling further comprises a shear tab protruding substantially perpendicularly from said planar surface.

16. The method of claim 14, wherein said securably attaching further comprises screwing a screw in said joist member into said means for joist coupling.

17. A metal floor system comprising:

a metal ledger beam suitable for affixing to a weight bearing structure;

a plurality of load transferring connections integrally formed along a length of said metal ledger beam; and a joist connected to a respective load transferring connection.

18. The apparatus of claim 17, wherein the plurality of load transferring connections each further comprise a rectangular punched out tab projecting 90° from a longitudinal planar surface of said metal ledger team.

19. The apparatus of claim 18, wherein a screw affixes a joist end to the tab.

20. The apparatus of claim 18 further comprising a second metal ledger beam mounted parallel to said metal ledger beam, said second metal ledger beam having a plurality of load transferring connections formed along its length, and said joist connected to said respective load transferring connection of said second metal ledger.

21. A metal ledger beam comprising:

a support tab punched out in a mid section of said metal ledger beam; and said support tab having an angled relation to a planar surface of said metal ledger beam and having a size sufficient to transfer a load from a joist connected thereto to a structural member of a building;

wherein the angled relation is 90 degrees, and the size sufficient to transfer a load is a rectangle having a pair of long sides mounted to a joist end.

22. An improved ledger beam comprising:

a length of metal having an inner face and suited to support a plurality of joists;

a shear tab formed into the inner face other than an end thereof;

said shear tab projecting inward from the inner face;

said shear tab having a size to provide a mechanical connection to transfer a joist load from an individual joist to the ledger beam;

wherein the mechanical connection further comprises screws.

23. The apparatus of claim 22, wherein the shear tab has a rectangular shape with a pair of long sides running at a 90° angle to a top of the ledger beam, said shear tab being perpendicular to the inner face.

24. The apparatus of claim 23, wherein the shear tab has a shape of a single-plate shear connection.

25. The apparatus of claim 22, wherein the inner face further comprises expansion bolt holes used for securing the ledger beam to a load bearing structural member.

26. The apparatus of claim 22, further comprising a plurality of said shear tabs.

27. A metal ledger beam comprising:

a support tab punched out in a mid section of said metal ledger beam; and said support tab having an angled relation to a planar surface of said metal ledger beam and having a size sufficient to transfer a load from a joist connected thereto to a structural member of a building;

further comprising screws to mount the support tab to the joist end.

* * * * *

US005956916C1

(12) EX PARTE REEXAMINATION CERTIFICATE (5491st)

United States Patent
Liss

(10) Number: US 5,956,916 C1
(45) Certificate Issued: Sep. 5, 2006

(54) SHEAR TAB METHOD AND APPARATUS

(75) Inventor: George Louis Liss, Littleton, CO (US)

(73) Assignee: Intel Corporation, Santa Clara, CA (US)

Reexamination Request:
No. 90/005,811, Sep. 5, 2000
No. 90/005,970, Apr. 2, 2001

Reexamination Certificate for:
Patent No.: 5,956,916
Issued: Sep. 28, 1999
Appl. No.: 08/961,635
Filed: Oct. 30, 1997

(51) Int. Cl.
*E04B 5/00* (2006.01)

(52) U.S. Cl. ..... 52/655.1; 52/656.9; 52/480; 52/650.1; 52/481.1; 52/281

(58) Field of Classification Search ..... 52/650.1, 52/650.3, 702, 653.1, 656.9
See application file for complete search history.

(56) References Cited

U.S. PATENT DOCUMENTS

| | | | | |
|---|---|---|---|---|
| 1,682,202 | A | | 8/1928 | Vaughn |
| 2,145,407 | A | | 1/1939 | Soule |
| 2,185,475 | A | | 1/1940 | Rafter |
| 2,966,708 | A | | 1/1961 | Freeman, Jr. |
| 3,083,794 | A | | 4/1963 | Stovall, Jr. |
| 3,668,828 | A | | 6/1972 | Nicholas et al. |
| 3,717,964 | A | * | 2/1973 | Brown et al. ..... 52/79.1 |
| 3,908,328 | A | | 9/1975 | Nelsson |
| 4,016,700 | A | | 4/1977 | Blomstedt |
| 4,058,941 | A | | 11/1977 | Zakrzewski et al. |
| 4,075,810 | A | | 2/1978 | Zakrzewski et al. |
| 4,078,347 | A | | 3/1978 | Eastman et al. |
| 4,197,952 | A | | 4/1980 | De Fouw et al. |
| 4,551,957 | A | | 11/1985 | Madray |
| 4,616,453 | A | | 10/1986 | Sheppard, Jr. et al. |
| 4,688,358 | A | | 8/1987 | Madray |
| 4,761,928 | A | | 8/1988 | Pichette |
| 4,793,113 | A | | 12/1988 | Bodnar |
| 4,866,899 | A | | 9/1989 | Houser |
| 4,909,007 | A | | 3/1990 | Bodnar |
| 4,918,899 | A | | 4/1990 | Karytinos |
| 5,207,045 | A | | 5/1993 | Bodnar |
| 5,313,752 | A | | 5/1994 | Hatzinikolas |
| 5,353,560 | A | | 10/1994 | Heydon |
| 5,394,665 | A | | 3/1995 | Johnson |
| 5,412,919 | A | | 5/1995 | Pellock et al. |
| 5,426,906 | A | | 6/1995 | McCracken |
| 5,527,625 | A | | 6/1996 | Bodnar |
| 5,592,848 | A | | 1/1997 | Bodnar |
| 5,596,859 | A | | 1/1997 | Horton et al. |
| 5,687,538 | A | | 11/1997 | Frobosilo et al. |
| 5,689,922 | A | | 11/1997 | Daudet |
| 5,857,306 | A | | 1/1999 | Pellock |

FOREIGN PATENT DOCUMENTS

| | | | | |
|---|---|---|---|---|
| AU | 23961/77 | | 4/1977 | |
| CA | 1192015 | | 8/1985 | |
| CA | 2077170 | * | 3/1994 | ..... 52/715 |
| JP | 6-49908 | * | 2/1994 | ..... 52/715 |
| JP | 9-4067 | | 1/1997 | |

* cited by examiner

*Primary Examiner*—Naoko Slack

(57) ABSTRACT

An improved ledger beam is provided which securely forms a load transferring connection with joist members without the need for separate material connectors which must be welded or fastened to the ledger beam. The ledger beam has a series of shear tabs integrally formed from the ledger beam's parent material which serve as points of fastening between the ledger beam and the joists. Also provided is a method of transferring loads from joist members to ledger members in a structural floor arrangement without the need for separate material connectors which must be welded or fastened to the ledger beam.

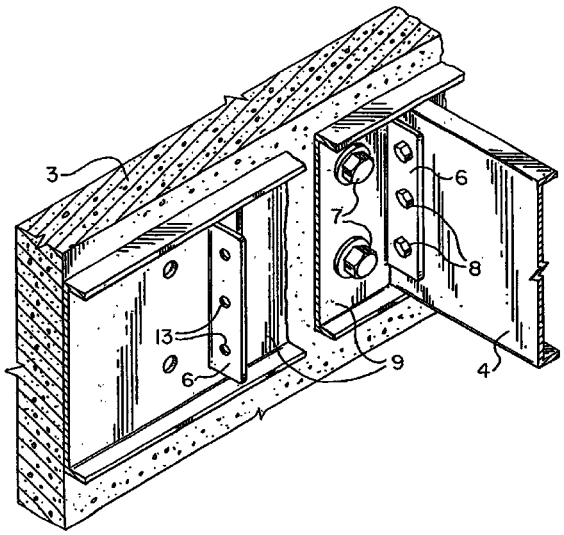

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–27 are cancelled.

* * * * *